US007727119B2

(12) United States Patent
Besendorfer et al.

(10) Patent No.: US 7,727,119 B2
(45) Date of Patent: Jun. 1, 2010

(54) HUMAN SELF-POWERED JOINT EXERCISER APPARATUS

(75) Inventors: Jeffrey R. Besendorfer, Heber, UT (US); Charles M. Andersen, Mapleton, UT (US)

(73) Assignee: TherapEase Innovation, LLC, Lindon, UT (US)

( * ) Notice: Subject to any disclaimer, the term of this patent is extended or adjusted under 35 U.S.C. 154(b) by 1529 days.

(21) Appl. No.: 10/950,850

(22) Filed: Sep. 27, 2004

(65) Prior Publication Data

US 2006/0073947 A1 Apr. 6, 2006

(51) Int. Cl.
*A63B 22/00* (2006.01)

(52) U.S. Cl. ..... 482/51; 482/95; 601/5

(58) Field of Classification Search ..... 482/79, 482/92, 97, 131, 142, 148, 901, 51, 95; 601/5, 601/16, 26, 27, 33, 34, 40, 79, 93, 98, 101, 601/115; 297/423.32
See application file for complete search history.

(56) References Cited

U.S. PATENT DOCUMENTS

| | | | | | |
|---|---|---|---|---|---|
| 2,387,966 | A | * | 10/1945 | Zander | 482/92 |
| 3,000,632 | A | * | 9/1961 | Fuchs | 482/97 |
| 4,089,330 | A | * | 5/1978 | Nicolosi et al. | 601/33 |
| 4,169,591 | A | * | 10/1979 | Douglas | 482/58 |
| 4,487,199 | A | | 12/1984 | Saringer | |
| 4,537,083 | A | | 8/1985 | Saringer | |
| 4,538,595 | A | | 9/1985 | Hajianpour | |
| 4,558,692 | A | * | 12/1985 | Greiner | 601/33 |
| 4,671,257 | A | | 6/1987 | Kaiser et al. | |
| 4,716,889 | A | | 1/1988 | Saringer | |
| 4,784,121 | A | * | 11/1988 | Brooks | 601/34 |
| 4,844,454 | A | * | 7/1989 | Rogers | 482/131 |
| 5,228,432 | A | | 7/1993 | Kaiser et al. | |
| 5,239,987 | A | | 8/1993 | Kaiser et al. | |
| 5,267,924 | A | | 12/1993 | Miller et al. | |
| 5,297,540 | A | | 3/1994 | Kaiser et al. | |
| 5,362,290 | A | * | 11/1994 | Huang | 482/100 |
| 5,399,147 | A | | 3/1995 | Kaiser | |
| 5,458,560 | A | | 10/1995 | Kaiser et al. | |
| 5,531,658 | A | * | 7/1996 | Liao | 482/142 |
| 5,620,410 | A | | 4/1997 | Kaiser et al. | |
| 6,106,445 | A | | 8/2000 | Lay | |
| 6,352,495 | B1 | * | 3/2002 | Hsu | 482/92 |
| 6,585,279 | B1 | * | 7/2003 | Galloway et al. | 280/304.1 |
| 7,108,645 | B2 | * | 9/2006 | Lincoln | 482/142 |
| 2002/0045844 | A1 | | 4/2002 | Beny et al. | |
| 2003/0073939 | A1 | | 4/2003 | Taylor et al. | |
| 2003/0120186 | A1 | * | 6/2003 | Branch et al. | 601/34 |
| 2004/0087880 | A1 | | 5/2004 | Mason et al. | |
| 2004/0127821 | A1 | | 7/2004 | Ou et al. | |

* cited by examiner

*Primary Examiner*—Loan H Thanh
*Assistant Examiner*—Tam Nguyen
(74) *Attorney, Agent, or Firm*—Steven L. Nichols; Vancott, Bagley, Corwall & McCarthy

(57) ABSTRACT

An apparatus for exercising a joint, the apparatus includes a movable platform for supporting a portion of a patient's body including the joint, and a manually-powered system for moving at least a portion of the platform to flex the joint, wherein the patient selectively operates the manually-powered system to control the flexing of the joint.

29 Claims, 5 Drawing Sheets

HUMAN SELF-POWERED JOINT EXERCISER APPARATUS

BACKGROUND

Continuous passive motion applied to an injured or post operative leg is the primary rehabilitative treatment chosen by most doctors and therapists. Many leg and joint exercising devices are known. Generally, these machines have a motor driven leg support, with the leg support capable of being set to periodically move the leg in a preset range of positions, for a preset length of duration, and at a preset speed. Once these angles, speed, and duration have been chosen, the machine automatically moves the leg from a straightened position back and forth into these pre-chosen positions at the pre-chosen speed for the pre-chosen duration.

Resetting positions and safety cutoffs are available for the user of current machines. However, because all variables are preset and constant, typically, initial therapy cycles of the machine are often too severe and painful, whereas, later therapy cycles are insufficient due to the limbering of the joint and the joint's capability of greater movement as the therapy session progresses. Further, current machines do not allow for total knee joint isolation, but require hip joint movement in order to achieve knee movement.

Current machines and therapists do not sense the pain of the patient at all and do a limited job of sensing stiffness. A machine is needed that will allow total flexibility in the treatment of the leg, including flexion, extension, duration, and speed, but in doing so, the machine needs to be sensitive to the pain threshold of the patient and the flexibility of the joint being exercised.

SUMMARY

An apparatus for exercising a joint, the apparatus includes a movable platform for supporting a portion of a patient's body including the joint, and a manually-powered system for moving at least a portion of the platform to flex the joint, wherein the patient selectively operates the manually-powered system to control the flexing of the joint.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

A joint exerciser apparatus is provided herein that allows for goal setting and attainment by the user. The machine allows for full extension and substantially full flexion of a substantially fully isolated joint. The machine makes therapy more effective and more efficient by putting greater control in the hands of the patient. This machine is useful for the treatment of several conditions, including intra-articular knee fracture, reconstructed knee ligaments, total knee joint replacement, and any others requiring the continuous passive motion of the knee joint.

In one exemplary embodiment, the joint exerciser apparatus allows the passive exercising of a joint. The exemplary joint exerciser apparatus has a table for sitting, to which is attached a human self-powered drive mechanism and a limb support mechanism. The human self-powered drive mechanism is attached through a power transmission system to the limb support mechanism. When the drive mechanism is rotated clockwise and then counter clockwise via human self-power, the limb support mechanism rotates at a reduced ratio so that the user can easily move his/her own limb through a full range of motion (full extension to substantially full flexion), at a desired speed and hold a position of flexion or extension for a desired duration. Substantially complete isolation of the joint is maintained throughout the flexion and extension cycle.

A general joint exerciser apparatus will first be discussed, followed by a brief discussion of a joint exerciser apparatus configured for exercising knee joints. Thereafter, the individual sub-assemblies of the joint exerciser apparatus will be discussed in detail, including the main frame, the leg support assembly, the drive train assembly, and the crank assembly.

In the following description, for purposes of explanation, numerous specific details are set forth in order to provide a thorough understanding of the present method and apparatus. It will be apparent, however, to one skilled in the art, that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Schematic Diagram of a Joint Exerciser Apparatus

Figure 1:
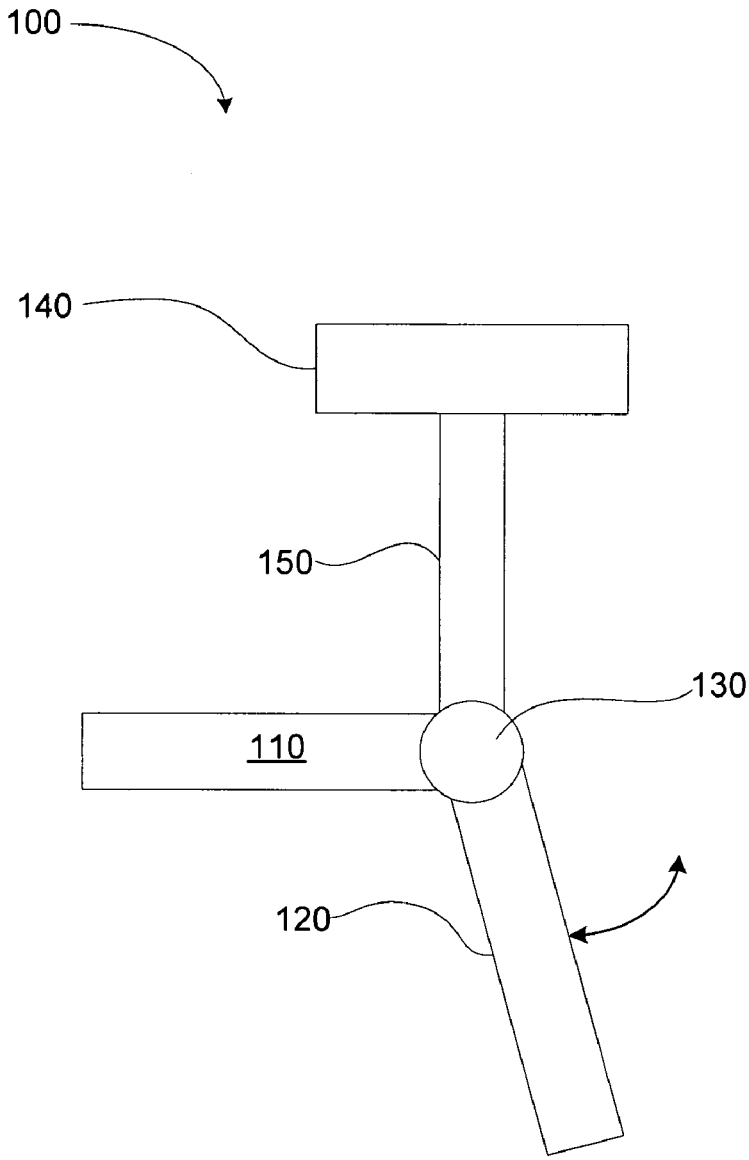
FIG. 1 illustrates a schematic diagram of an exemplary joint exerciser apparatus.

FIG. 1 is a general schematic view of a joint exerciser apparatus (100). The joint exerciser apparatus (100) generally includes an upper-limb support (110) and a lower-limb support (120). The lower-limb support (120) pivots with respect to the upper-limb support (110). Further, the lower-limb support (120) is configured to have a lower part of the limb attached thereto, such that as the lower-limb support (120) is rotated, the lower part of the patient's limb follows. As the lower part of the patient's limb follows the movement of the lower-limb support, the joint is exercised. The motion of the joint as the limb is drawn back on itself is referred to as flexion while the motion of the limb as it is straightened is referred to as extension. The range between flexion and extension is referred to as range of motion. By independently supporting the upper and lower portions of the patient's limb, the lower portion of the limb alone may be moved through the range of motion, thereby substantially isolating the movement of the joint from the movement of other joints in the limb.

This isolation of the joint to be exercised is further enhanced by providing a motive force separate from the patient's own exertion with respect to the limb and joint to be exercised. For example, if the patient is exercising a knee, the joint exerciser apparatus moves the lower leg while minimizing or eliminating the need for the patient to use his/her leg muscles to move the lower leg. The rotational force used to move the lower-limb support (120) may be applied to a pivot (130) that is coupled to the lower-limb support (120). Further, this motive force is generated by the patient, such as through the use of a crank assembly (140). The output of the crank assembly (140) may then be transferred from the crank assembly (140) to the pivot through a power transmission assembly (150). Accordingly, the joint exerciser apparatus (100) is configured to be driven by the patient him/herself while allowing the joint to be exercised in isolation. The manually driven joint exerciser apparatus such as the one shown (100) may be configured to be used with any joint to be exercised. An exemplary joint exerciser apparatus (200) will now be discussed in the context of exercising a knee joint.

Joint Exerciser Apparatus

Figure 2:
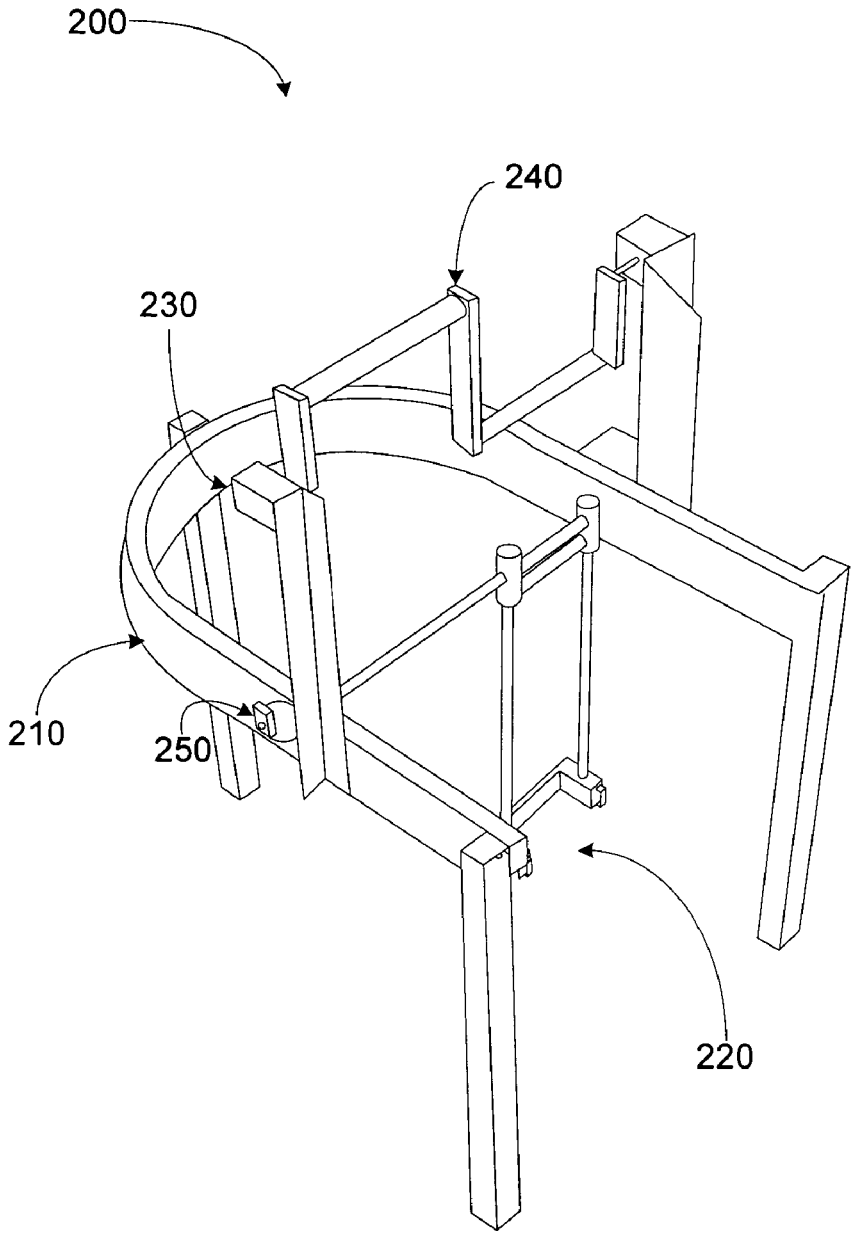
FIG. 2 illustrates a perspective view of an exemplary joint exerciser apparatus adapted to exercise knee joints.

FIG. 2 illustrates one exemplary joint exerciser apparatus (200) that generally includes a main frame (210), a leg support assembly (220), a drive train assembly (230), and a crank assembly (240). The main frame (210) is coupled to the leg support assembly (220) and the drive train assembly (230). The drive train assembly (230) in turn is coupled to the crank assembly (240).

In particular, the leg support assembly (220) is pivotably supported on one end thereof to the main frame (210) and is rotatingly coupled on the other end to the drive train assembly (230). The drive train assembly (230) is then connected to the crank assembly (240). More specifically, the crank assembly (240) is pivotably coupled on one end to one side of the drive train assembly (230) while the other end is rotatingly coupled to the other side of the drive train assembly (230).

The drive train assembly (230) translates the rotation of the crank assembly (240) to rotation in the leg support assembly (220). Accordingly, rotation of the crank assembly (240) causes rotation of the leg support assembly (220). This rotation is accomplished while isolating a single joint and allowing the user to control the range of motion with respect to flexion and extension; speed; and duration, in light of personal factors such as pain and stiffness. For ease of reference, the joint exerciser apparatus will be discussed with reference to the exercise or therapy of a knee joint. The apparatus (200) also includes a brake assembly (250). The brake and angle meter assembly (250) allow a patient to easily determine the angle of rotation and to fix the leg support assembly (220) at a given rotation.

Each of the assemblies includes several components. Accordingly, each assembly will be discussed in more detail. In particular, the components of the main frame (210) will be discussed first, followed by a discussion of the leg support assembly (220), the drive train (230), and the crank assembly (240).

Main Frame

Figure 3A:
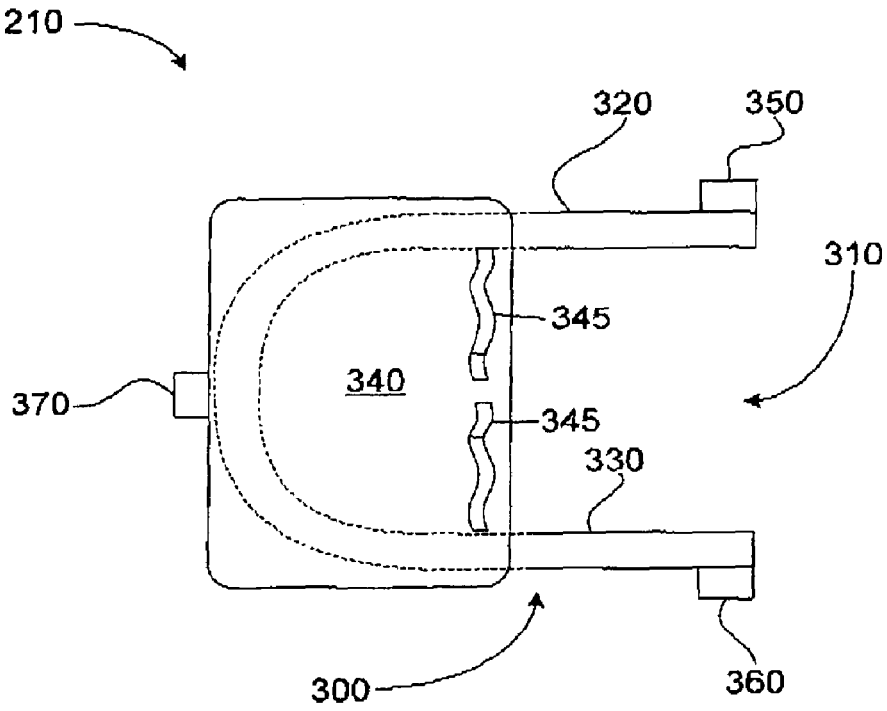
FIG. 3A illustrates a top view of an exemplary main frame.
Figure 3B:
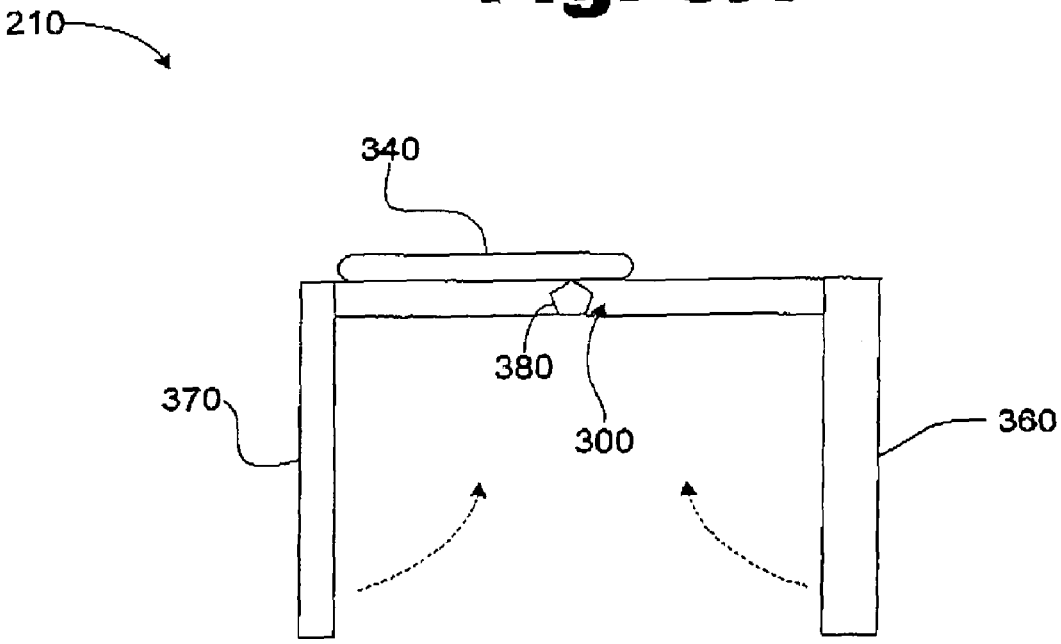
FIG. 3B illustrates a side view of an exemplary main frame.

FIGS. 3A and 3B illustrate the main frame (210). The main frame (210) includes a generally U-shaped sub-frame (300). Accordingly, a gap (310) is defined between opposing arms (320, 330) of the table portion (300). The gap (310) of the exemplary main frame (210) is sized to allow at least one leg to be positioned within the main frame (210) and may be sized to allow both legs to be positioned within the main frame.

The main frame (210) may include a support, such as a generally flat table (340) that extends between the opposing arms to support a patient thereon. In such a configuration, the patient would sit on the table (340) and place the knee to be exercised near the end of the table (340) and within the gap (310). The thigh of the knee to be exercised would be held still by straps (345) attached to the table (340). Consequently, the lower part of the leg would extend beyond the table (340) such that the lower part of the leg would be suspended by the table (340). For convenience, the gap (310) may be sized to allow the patient to extend both legs from the table (340).

The configuration of the main frame (210) helps ensure that the patient is able to move the knee through a substantially full range of motion while minimizing contact between the leg and the ground or other surfaces. The exemplary main frame (210) shown is configured to allow a patient to rest both legs on the table (340), such that the knees are near the end of the table (340) and the lower legs are suspended.

The main frame (210) also includes three hinged legs (350, 360, 370) that support the U-shaped sub-frame (300). These legs (350, 360, 370) are sufficiently long to ensure that the lower portion of the leg does not come into contact with the ground or other surfaces as it moves through its range of motion. In addition, the legs (350, 360, 370) fold down such that the apparatus (100) may be more easily stored or transported.

Figure 7:
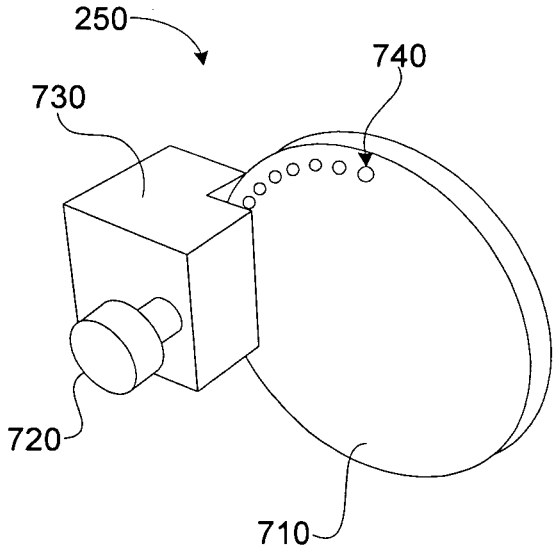
FIG. 7 illustrates an exemplary brake assembly.

An angle meter (380) is attached to the frame to provide flexion angle feedback to the user. The angle meter (380) indicates the angle of flexion by pointing to an angle number found on the round disk (710; FIG. 7). Although the current angle device shown is mechanical in nature, more sophisticated devices using encoders and an electronic display could also be used to provide similar data in more detail.

Accordingly, the main frame (210) provides a stable platform to support the joint to be exercised while providing a substantially full range of motion. The main frame (210) is also configured to support the leg support assembly (220) and the drive train assembly (230).

Leg Support Assembly

Figure 4:
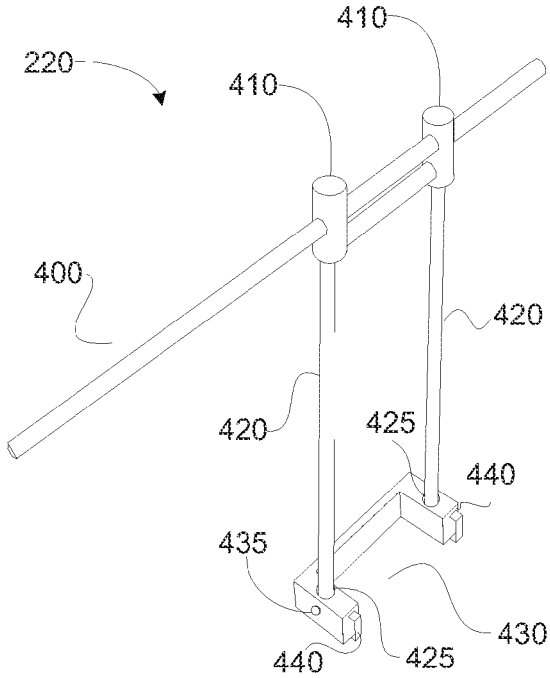
FIG. 4 illustrates an exemplary leg support assembly.

FIG. 4 illustrates the leg support assembly (220) in more detail. The leg support assembly (220) includes lateral adjustments and radial adjustments. These adjustments allow the joint exerciser apparatus (200; FIG. 2) to be adapted for use with either leg and for use by patients having limbs of different dimensions. The leg support assembly (220) includes a hexagonal drive shaft (400), shaft sleeves (410), opposing parallel guide rods (420), and a limb attachment mechanism (430).

The shaft sleeves (410) shown slides on bushings (425) which allow the shaft sleeves (410) to be moved laterally along the drive shaft (400). This configuration allows the shaft leg support assembly (220) to be positioned to allow the patient to exercise either leg. For example, if the patient desires to exercise the left knee, the shaft sleeves (410) are moved along the drive shaft (400) until it is in position with respect to the left knee. Accordingly, the mobility of the shaft sleeves allows a patient to use the joint exerciser apparatus (200; FIG. 2) with either leg.

In addition to allowing adjustment of the lateral position of the shaft sleeve (410), the leg support assembly (220) is also configured to allow adjustment of the radial distance between the drive shaft (400) and the limb attachment mechanism (430). In particular, the limb attachment mechanism (430) is coupled to the parallel rods (420) via linear glide bushings (425). These bushings (425) allow the limb attachment mechanism (430) to slide along the parallel rods (420), thereby varying the radial distance from the drive shaft (400) to the limb attachment mechanism (430).

It may be desirable to vary the distance between the drive shaft (400) and the limb attachment mechanism (430) to better accommodate the attachment of a patient's limb to the joint exerciser apparatus (200; FIG. 2). For example, the patient is able to slide the limb attachment mechanism (430) until the limb attachment mechanism (430) is at a comfortable location on the leg. Further, because the drive shaft is not centered in relationship to the patient's knee, the radial distance from the drive shaft to the limb attachment mechanism varies as the patient's limb is moved through the flexion and extension cycle.

The leg support assembly (220) includes a locking mechanism (435) coupled to the limb attachment mechanism (430) for securing the limb attachment mechanism (430) in the proper position while the patient is mounting the machine. The limb attachment mechanism (430) also includes strap mounts (440). The strap mounts (440) are configured to allow straps (not shown) to be mounted thereto. The straps may then be used to secure the lower part of a patient's leg to be attached to the limb attachment mechanism (430).

When the lower leg is attached to the limb attachment mechanism (430), the lower leg will follow the limb attachment mechanism (430). The limb attachment mechanism (430) is rotated when the drive shaft (400) is rotated. In particular, the drive shaft (400) has a generally hexagon shape as does the inside of the shaft sleeves (410). This configuration causes the shaft sleeves (410) to rotate with the drive shaft (400). The parallel rods (420) are coupled to the shaft sleeves (410), such that as the drive shaft rotates, so do the parallel rods (420), the limb attachment mechanism (430), and the lower part of the patient's leg. As the lower part of the patient's leg is rotated, the knee joint is exercised.

As introduced, the leg support assembly (220) is coupled to the drive train assembly (230) and the crank assembly (240) such that the input of the crank assembly (240) drives the leg support assembly (220). The function of the drive train assembly (230), the function of the crank assembly (240), and the interaction between the two will now be discussed in more detail.

Drive Train Assembly and Crank Assembly

Figure 5:
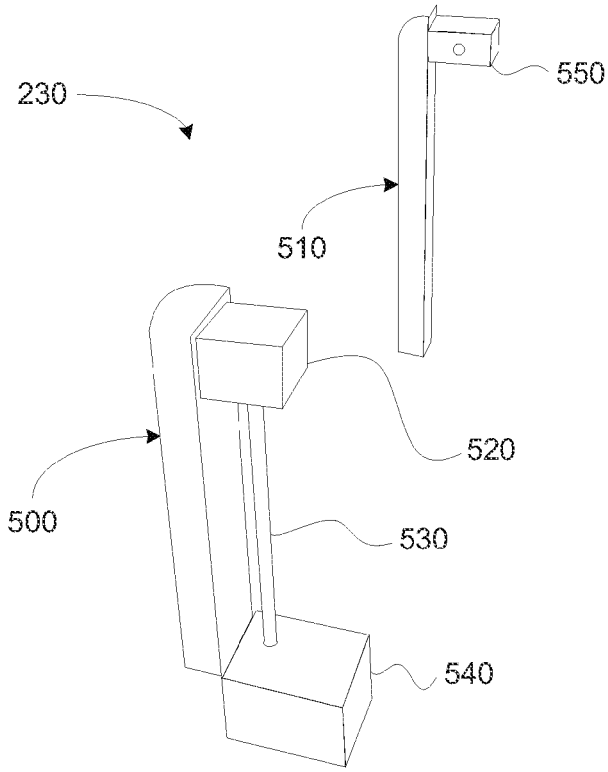
FIG. 5 illustrates an exemplary drive train assembly.
Figure 6:
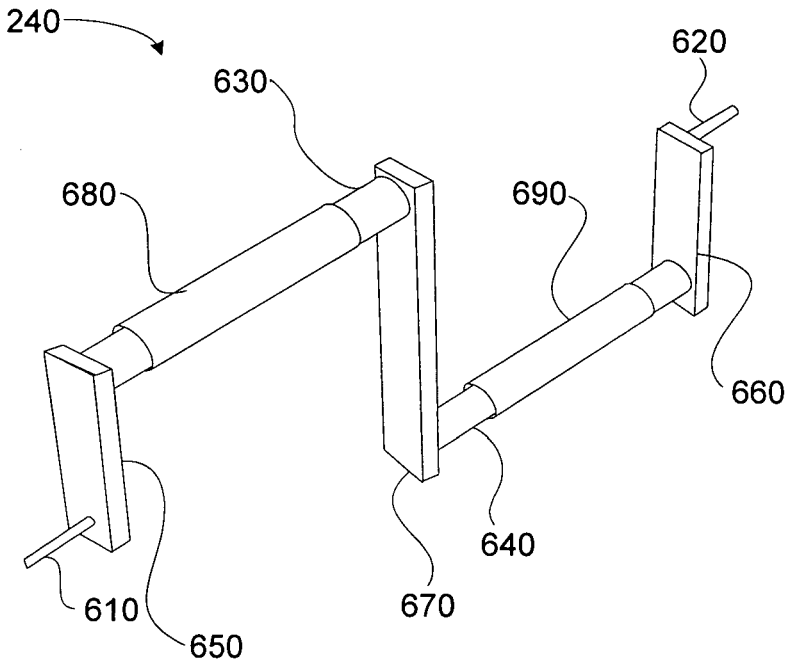
FIG. 6 illustrates an exemplary crank assembly.

FIGS. 5 and 6 illustrate the drive train assembly and the crank assembly respectively. The drive train assembly and the crank assembly shown form a human self-powered drive mechanism. As seen in FIG. 5, the drive train assembly (230) includes two spaced apart structures (500, 510). The structures (500, 510) are configured to be coupled to the main frame (210; FIG. 2) of the joint exerciser apparatus (200; FIG. 2). In particular, the structures (500, 510) may be hinged such that the structures may be folded substantially flat with respect to the U-shaped sub-frame (300). Accordingly, the apparatus (200; FIG. 2) may be adapted for home use as the legs and the structures may be folded to reduce the size of the apparatus for storage and transportation.

Several components are coupled to the first structure (500). These components include a right-angle gear box (520), a connecting shaft (530), and a gear reduction mechanism (540). The gear reduction mechanism (540) includes a wheel and a worm gear drive. The right-angle gear box (520) receives an input from the crank assembly (240; FIG. 2) via a first end member (610; FIG. 6). The right-angle gear box (520) changes the rotational input from the crank assembly, which is rotating about a horizontal axis to a rotation about a vertical axis of the connecting shaft (530). The connecting shaft (530) in turn is coupled to the gear reduction mechanism (540).

The gear reduction mechanism (540) translates the rotation of the connecting shaft (530) to the drive shaft (400) of the leg support assembly (220). The gear reduction mechanism (540) also lowers the rate of rotation of its output with respect to the input. For example, the exemplary gear reduction mechanism (540) has a 20:1 gear ratio, such that 20 rotations of the crank assembly (240; FIG. 2) correspond to one rotation of the drive shaft (400). This gear reduction allows a patient to better control the motion of the leg support assembly (220) and hence the flexion and extension of the knee joint being exercised and the speed and duration of that movement.

Accordingly, the drive train assembly (230) translates motion from the crank assembly (240; FIG. 2) to motion in the leg support assembly (220). Further, the drive train assembly (230) is coupled to the crank assembly (240; FIG. 2) with respect to the main frame (210). In particular, the first structure (500) has the right-angle gear box (520) attached thereto and is pivotable so that it can be folded parallel to the frame. As previously discussed, the right-angle gear box (520) receives an input from the crank assembly (240; FIG. 2). In doing so, the right-angle gear box (520) is coupled to one end of the crank assembly. The other end of the crank assembly (240; FIG. 2) is supported by a pillow block (550) coupled to the second structure which is also pivotable so that it can be folded parallel to the frame (510). The pillow block (550) includes an opening defined therein to accommodate the other end of the crank assembly (240; FIG. 2) to thereby allow the crank assembly (240) to rotate. To this point, the rotational input of the crank assembly (240) has been described generally as rotation. The operation of the crank assembly will now be discussed in more detail.

Crank Assembly

FIG. 6 illustrates the crank assembly (240) in more detail. The crank assembly generally includes first and second end members (610, 620), first and second handle members (630, 640), end support plates (650, 660), and a central support plate (670). The first and second handle members also have first and second handle sleeves (680, 690) which rotate freely upon the first and second handle members thereby preventing excess wear and tear on the hands of the patient who is operating the machine. An axis of rotation is defined by a line extending between the first and second end member (610, 620). In other words, the crank assembly (240) rotates about an axis between the first and second end members (610, 620). As shown in FIG. 6, end support plates (650, 660) and the central support plate (670) are arranged such that the first and second handle members (630, 640) are arranged offset with respect to the axis of rotation previously described. The distance of this offset corresponds to the length of the moment arms of the crank assembly. Accordingly, the offset allows a patient to more easily drive the crank assembly. Further, the first end member (610) acts as a coupler to attach the crank assembly (240) to the right angle gear box. In particular, the interaction between the first end member (610) and the right angle gear box (510; FIG. 5) may be similar to a socket and ratchet system with a square shaft on the first end member (610) and a square bore in the right angle gear box (510; FIG. 5) so that the crank mechanism can be easily attached or detached.

Brake Assembly

FIG. 7 illustrates the brake and angle meter assembly (250). The braking mechanism includes a round disk (710). The round disk (710) is coupled to the drive shaft (400; FIG. 4), such that when the drive shaft (400; FIG. 4) rotates, the round disk (710) also rotates and vice versa. The brake and angle meter assembly (250) also includes a pin (720) that is coupled to a support (730). The support (730) is secured to the main frame (210; FIG. 2) such that the support (730) remains stationary with respect to the main frame (210; FIG. 2). The support (730) is placed in proximity to the round disk (710) such that the disk is free to rotate. Further, the support (730) also slidingly supports the pin (720).

This configuration allows the pin (720) to be placed within indexing holes (740) that are drilled in the round disk (710).

When the pin (720) is placed in the indexing holes (740), the fixed nature of the support (730) prevents the round disk (710) from rotating, thereby locking the drive shaft (400; FIG. 4) and consequently the leg support (220) in place. Accordingly, the brake and angle meter assembly (250) allows a patient to pause the flexion or extension at a desired location for a desired length of time. Further, the indexing holes (740) are angularly spaced at 10 degree increments along the outer surface of the round disk (710), thereby allowing the round disk (710) to be locked at a selected location anywhere from 0 to 90 degrees of flexion. The round disk (710) also has angles of flexion indicated on the top side. The angle of flexion is read by checking to which angle the angle meter (380; FIG. 3) points.

In conclusion, a joint exerciser apparatus has been described herein that allows for goal setting and attainment by the user. The machine allows for full extension and substantially full flexion of a substantially fully isolated joint. The machine makes therapy more effective and more efficient by putting greater control in the hands of the patient. This machine is useful for the treatment of several conditions, including intra-articular knee fracture, reconstructed knee ligaments, total knee joint replacement, and any other requiring the continuous passive motion of the knee joint.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the disclosure be defined by the following claims.

What is claimed is:

1. An apparatus for exercising a knee joint, said apparatus comprising:

a first platform for supporting at least a portion of a patient's upper leg above the patient's knee joint;

a movable platform for supporting at least portion of a patient's lower leg below the patient's knee joint; and a manually-powered system for moving said movable platform relative to said first platform to flex said knee joint, wherein said movable platform is movable with respect to said first platform such that said lower leg can be moved through a full range of motion of said knee joint;

wherein said apparatus allows for the patient to selectively operate said manually-powered system to control said flexing of said joint; and wherein said manually-powered system includes a hand crank assembly, said hand crank assembly being coupled to said movable platform such that said patient is enabled to manually drive said movable platform to flex said knee joint.

2. The apparatus of claim 1, wherein said movable platform and said first platform are joined by a pivot member coupled to said movable platform, such that said movable platform pivots with respect to said first platform.

3. The apparatus of claim 1, wherein said manually-powered system is configured to be operated by a hand of said patient without said patient applying force with a leg comprising said knee joint.

4. The apparatus of claim 2, wherein said moveable platform is configured to be selectively translated along said pivot member.

5. The apparatus of claim 1, wherein said movable platform is configured to support a lower leg of the patient.

6. An apparatus for exercising a knee joint, said apparatus comprising:

a movable platform for supporting a portion of a patient's body including a knee joint; and a manually powered system for moving at least a portion of said platform to flex said knee joint;

wherein said apparatus allows for the patient to selectively operate said manually powered system to control said flexing of said knee joint; and wherein said manually powered system includes a worm gear, such that operation of a patient control device, through a gear ratio, drives movement of said movable platform to flex said knee joint.

7. The apparatus of claim 1, wherein said manually-powered system comprises a worm gear that helps maintain a desired angle of flexion or extension for a desired duration.

8. The apparatus of claim 1, further comprising a braking assembly coupled to said movable platform to aid the patient in mounting and dismounting said apparatus.

9. The apparatus of claim 1, further comprising an angle meter coupled to said movable platform.

10. The apparatus of claim 1, further comprising a plurality of straps coupled to either said first or said movable platform.

11. The apparatus of claim 10, wherein said straps comprise hook and loop closure straps.

12. The apparatus of claim 1, wherein said movable platform further comprises a drive shaft, shaft sleeves coupled to said drive shaft, a plurality of parallel rods coupled to said shaft sleeve, a leg support coupled to said parallel rods, and glide bushings located between said rods and said leg support.

13. The apparatus of claim 1, further comprising first and second spaced apart structures configured to support said manually-powered system.

14. The apparatus of clam 13, wherein said first and second spaced apart structures are configured to be folded with respect to said first platform to facilitate portability of said apparatus.

15. The apparatus of claim 1, wherein said manually-powered system includes a crank assembly, said crank assembly having a plurality of sleeves slidingly coupled thereto.

16. The apparatus of claim 6, further comprising at least one strap coupled to said movable platform, said strap being configured to secure said patient to said apparatus during extension and flexion.

17. The apparatus of claim 6, further comprising a braking mechanism coupled to said movable platform to aid the patient in mounting and dismounting said apparatus.

18. A method of exercising a knee joint for rehabilitation, comprising:

supporting at least a portion of a patient's upper leg or body above the knee joint with a first platform;

supporting at least a portion of a patient's lower leg or foot below the knee with a movable platform; and manually controlling a geared system to move said movable platform with respect to said first platform to flex and extend said knee joint wherein said patient selectively operates said manually-controlled system to control said flexing and extending of said joint, such that operation of a patient control device, through a gear ratio, drives movement of said movable platform to flex and extend said knee joint repeatedly for rehabilitation.

19. The method of claim 18, wherein manually controlling said system comprises manually powering said system by turning a hand crank.

20. The method of claim 18, further comprising securing said upper leg relative to said movable platform to isolate said knee joint.

21. The method of claim 18, wherein movable platform has a range of motion relative to said first platform such that said knee joint can be moved through a full range of motion of said knee joint.

22. The method of claim 18, further comprising selectively pausing said flexing at a desired position.

23. The method of claim 22, wherein pausing said flexing at said desired position includes selectively engaging a brake mechanism.

24. The apparatus of claim 6, wherein said manually-powered system is configured to be operated by said patient without said patient applying force with a limb comprising said joint being flexed.

25. The apparatus of claim 6, further comprising an angle meter coupled to said movable platform.

26. The apparatus of claim 16, wherein said at least one strap comprises a hook and loop closure.

27. The apparatus of claim 6, further comprising first and second spaced apart structures configured to support said manually-powered system.

28. The apparatus of clam 27, wherein said first and second spaced apart structures are configured to be folded to facilitate portability of said apparatus.

29. The apparatus of claim 6, wherein said manually-powered system includes a crank assembly, said crank assembly having a plurality of sleeves rotatingly coupled thereto.

* * * * *